US005127861A

United States Patent [19]

Ross

[11] Patent Number: 5,127,861

[45] Date of Patent: Jul. 7, 1992

[54] COMBINATION LEASH ATTACHMENT AND LOCK FOR SURFBOARD

[76] Inventor: Melvin C. Ross, 34822 Camino Capistrano, Capistrano Beach, Calif. 92624

[21] Appl. No.: 604,221

[22] Filed: Oct. 29, 1990

[51] Int. Cl.[5] ..... B63B 1/00

[52] U.S. Cl. ..... 441/75; 114/357; 441/74

[58] Field of Search ..... 441/74, 75, 79, 65, 441/73; 114/39.2, 357; 70/14, 18, 30, 49, 57; 156/267, 293

[56] References Cited

U.S. PATENT DOCUMENTS 4,267,615 5/1981 Nealy ..... 441/75
4,712,394 12/1987 Bull ..... 441/74
4,804,347 2/1989 Ross ..... 441/79

*Primary Examiner*—Edwin L. Swinehart

*Attorney, Agent, or Firm*—Roy A. Ekstrand

[57] ABSTRACT

A combination leash attachment and lock for surfboard includes a generally cylindrical plug receptacle having an outwardly extending annular lip and cylindrical end portions is received within a cylindrical aperture within a surfboard foam core. An assembly process shows the fabrication of a surfboard in a manner securing the plug receptacle within the foam core. Following the fiberglassing step of surfboard fabrication, the extending end portions of the plug receptacle are removed by sanding, grinding or other suitable processes. The plug receptacle defines an interior recess which receives a generally cylindrical leash plug to which an ankle leash may be secured and extend from the upper surface of the surfboard. With the leash plug removed, the plug receptacle provides a convenient passage through the surfboard which may be used to carry a locking mechanism or other security apparatus to prevent theft of the surfboard.

11 Claims, 2 Drawing Sheets

COMBINATION LEASH ATTACHMENT AND LOCK FOR SURFBOARD

FIELD OF THE INVENTION

This invention relates generally to surfboards and particularly to those using an ankle leash or similar restraining device.

BACKGROUND OF THE INVENTION

The sport of surfing has become extremely popular over many parts of the world having great numbers of enthusiasts in virtually any seashore area having useable surf and coast line. Practitioners of the sport of surfing become extremely skilled and by cleverly maneuvering their surfboards to the inward side of a moving wave, they are able to stand upright upon their surfboards and literally ride the waves into the shore. While the skill levels of surfers are often amazing, even the most skilled surfer is likely to endure several falls during the course of a day of surfing. Because such falls occur most frequently in the turbulent or tumultuous areas of the wave which the surfer is riding or attempting to ride, a fall subjects the surfer to several problems and risks. Two of such problems arise in connection with the size and buoyancy of the surfboard itself. Once the surfer is plunged into the turbulence of the wave, all control over the surfboard itself is lost. In many cases, the surfer and the surfboard are repeatedly tumbled as they plunge under the power of the wave. Thus, one problem arising is the great separation which may occur between the surfer and the surfboard during such tumultuous falls. The surfer may find his or herself separated from their surfboard by a substantial distance or may find the surfboard continuing to be carried inward by the wave leaving the surfer behind. While this problem is inconvenient, it is by no means the most serious problem associated with falls. A far more serious possibility arises in that the surfer tumbling about in a wave along with his or her surfboard may actually be struck by the surfboard itself. This hazard has become even greater because of the extreme buoyancy and streamlined often pointed shapes of modern surfboards and the sharp underside fins which they utilize. The majority, if not all, of today's surfboards are formed of an extremely strong lightweight foam core having substantial rigidity and buoyancy. The fiber core is shaped in a hydrodynamically streamlined shape having generally flat top and bottom surfaces. A thin tough and preferably smooth fiberglass skin is formed about the lightweight foam core and one or more sharp downwardly extending fins are supported on the underside rear portion of the surfboard.

To meet the problems associated with the safety risks to surfers in collision with surfboards, practitioners in the art often provide an ankle leash formed of a flexible cord or belt material which is secured to a recessed plug attachment in the upper surface of the surfboard. Thus, the surfer employing such a device, slips the flexible leash about one ankle with the remaining end secured to the plug. The object in using such a surfboard leash is to provide a means by which the surfer and surfboard do not become separated in the event of a fall.

Another problem arising in the use of surfboards is surfboard theft. Modern boards are usually very costly and, what is worse, because they are light and small they are easy to steal if left unattended. In the typical beach environment, however, in which surfing often occurs, there is often a desire on the part of surfers to spend periods of time in activities and sports other than surfing itself. However, care must be taken to avoid leaving the valuable surfboards unattended which often restricts the activities available to such beachgoers.

There remains, therefore, a need in the art for a convenient reliable and easy to use security device for surfboards.

SUMMARY OF THE INVENTION

Accordingly, it is a general object of the present invention to provide an improved surfboard. It is a more particular object of the present invention to provide an improved surfboard having a safe, convenient and reliable security mechanism available. It is a still more particular object of the present invention to provide a security device for a surfboard which also protects the surfer during surfing activities.

In accordance with the present invention, there is provided for use in a surfboard having a body portion, top and bottom surfaces, a combination leash attachment and lock means comprising: a plug receptacle having a passage therethrough and upper and lower edge portions; means supporting the plug receptacle within the surfboard such that the upper and lower edges thereof are generally flush with the top and bottom surfaces of the surfboard; and a leash plug, having leash attachment means for securing an ankle leash, configured for removable assembly to the plug receptacle.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
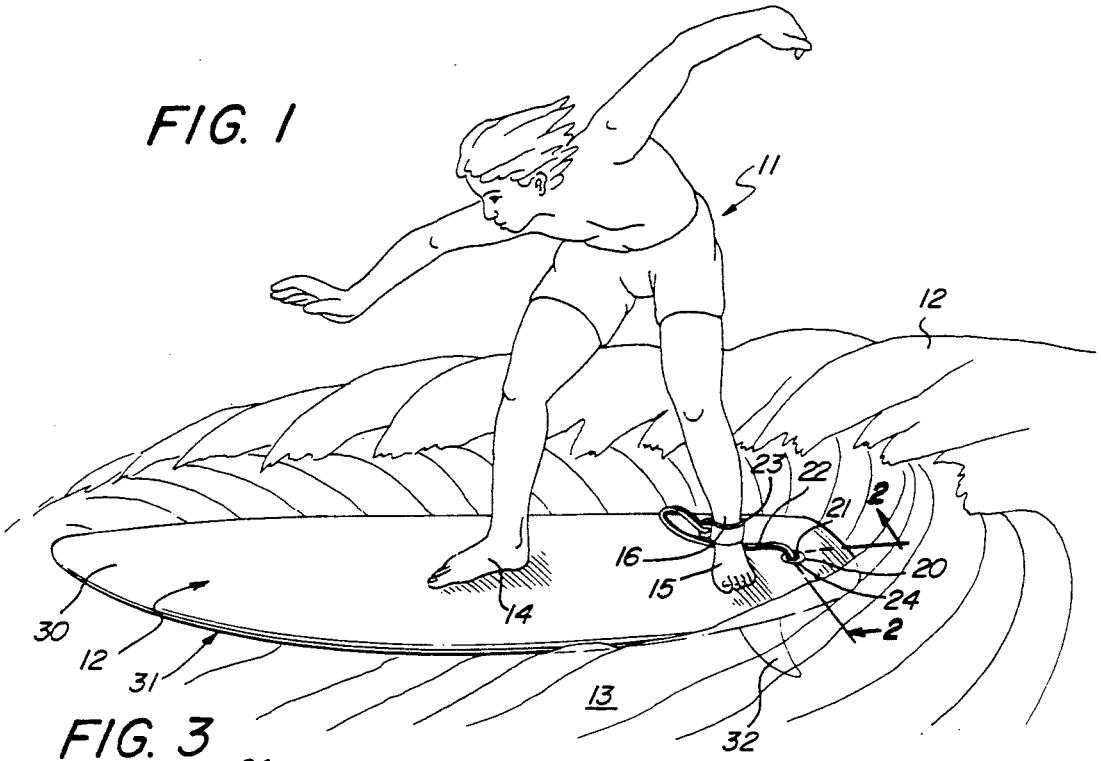
FIG. 1 sets forth a perspective view of a combination leash attachment and lock supported on a surfboard in a typical surfing activity.

FIG. 1 sets forth a perspective view of a surfboard constructed in accordance with the present invention and generally referenced by numeral 10. Surfboard 10 is shown in a typical surfing environment in which a surfer 11 is supported upon upper surface 30 of surfboard 10 having feet 14 and 15 positioned upon upper surface 30 for balance and maneuverability. In the surfing environment shown, the water surface 13 forms an upwardly extending rolling wave 12, the force of which is operative to propel surfer 11 and board 10 forwardly in the direction shown in FIG. 1. Surfboard 10 also defines a smooth undersurface 31 supporting a downwardly extending fin 32.

In accordance with the present invention, a generally cylindrical plug receptacle 20 is supported within an aperture 24 defined in the rear portion of surfboard 10. In further accordance with the present invention, plug receptacle 20 supports a leash plug 25 (seen in FIG. 2) and a flexible leash 22 secured thereto. Leash 22 further includes an ankle loop 23 at its other end which is secured to ankle 16 of surfer 11.

Thus, in accordance with typical surfing techniques, surfer 11 balances upon surfboard 10 and is propelled forward upon water surface 13. In the event of a fall, the length of ankle leash 22 and the secure attachment of leash plug 25 to surfboard 10 via plug receptacle 20 avoids the above-described problems by maintaining surfboard 10 in the proximity of surfer 11.

Figure 2:
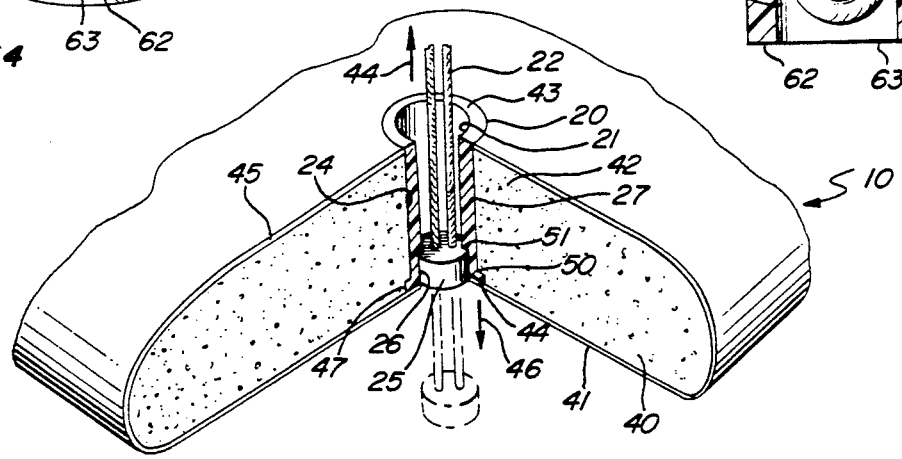
FIG. 2 sets forth a partial section view of the present invention combination leash attachment and surfboard lock taken along section lines 2—2 in FIG. 1.

FIG. 2 sets forth a partial section view of surfboard 10 showing the present invention combination leash attachment and lock taken along section lines 2—2 in FIG. 1. As described above, surfboard 10 includes a buoyant rigid foam core 40 shaped in the desired hydrodynamic shape such as that shown in FIG. 1. Foam core 40 further defines an upper surface 42 and an undersurface 41. Foam core 40 further defines a cylindrical aperture 24 extending from upper surface 42 to undersurface 41. Undersurface 41 further defines an annular recess 50 encircling aperture 24.

A plug receptacle 20 constructed in accordance with the present invention and set forth below in greater detail defines a generally cylindrical shape having a cylindrical center passage 21 extending therethrough. Plug receptacle 20 further defines a radially extending lip 47 and an interior annular ridge 51. In further accordance with the present invention, plug receptacle 20 is precisely received within aperture 24 such that lip 47 is received in recess 50 and ridge 51 faces downwardly. Surfboard 10 further includes a smooth fiberglass skin 45 which surrounds and adheres to foam core 40. In further accordance with the present invention, plug receptacle 20 defines a top edge 43 which, in the manner set forth below, is flush with fiberglass skin 45. Similarly, plug receptacle 20 defines a bottom edge 44 which, in the manner set forth below in greater detail, is flush with fiberglass skin 45. As is also described below in greater detail and in accordance with an important aspect of the present invention, fiberglass skin 45 covers a portion of lip 47 to secure plug receptacle 20 within foam core 40.

A leash plug 25 constructed in accordance with the present invention and having a generally cylindrical shape is received within plug recess 26 of plug receptacle 20 and abuts ridge 51 therein. In the manner set forth below in greater detail, a flexible ankle leash 22 is secured to leash plug 25 and extends upwardly through center passage 21 and is secured to the surfer's ankle in the manner shown in FIG. 1.

In the assembly shown in FIGS. 1 and 2, leash plug 25 is secured within plug receptacle 20 and resists pulling forces in the direction indicated by arrow 44 due to the interference of ridge 51 and the precision size of leash plug 25. In addition, the extension of lip 47 within foam core 40 secures plug receptacle 20 within foam core 40 and provides a secure attachment means for leash plug 25.

In accordance with an important aspect of the present invention, leash plug 25 is easily removed from plug receptacle 10 by releasing ankle loop 23 and forcing leash plug 25 downwardly in the direction indicated by arrow 46 to the dashed line position shown in FIG. 2. Thereafter, leash plug 25 and ankle leash 22 may be drawn in the direction indicated by arrow 46 to completely clear center passage 21. It should be noted at this point that in accordance with an important aspect of the present invention described below in greater detail, the remaining cylindrical member formed by plug receptacle 20 and its secure attachment within surfboard 10 provide the availability of center passage 21 to employ a virtually endless variety of security devices. With temporary reference to FIG. 5, it will be noted that a simple chain and lock mechanism can be used to securely attach surfboard 10 to an immovable object such as post 60 shown in FIG. 5.

Figure 3:
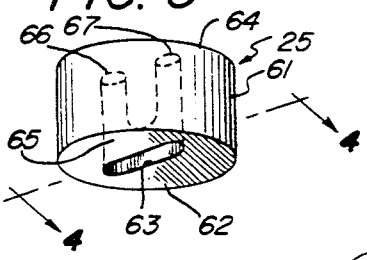
FIG. 3 sets forth a perspective view of a leash plug constructed in accordance with the present invention.

FIG. 3 sets forth a perspective view of leash plug 25 viewed from its underside. Leash plug 25 which, in its preferred form is formed of a molded plastic material or the like, defines a generally cylindrical member having a generally cylindrical sidewall 61 and a planar bottom surface 62 and top surface 64. Leash plug 25 further defines a pair of spaced generally circular apertures 66 and 67 defined in top surface 64 and an elongated slot 63 defined in bottom surface 62. A generally U-shaped passage 65 extends between and interconnects apertures 66, 67 and slot 63.

Figure 4:
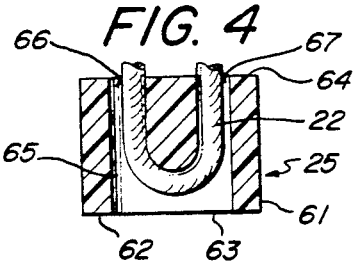
FIG. 4 sets forth a section view of the present invention leash plug taken along section lines 4—4 in FIG. 3.

FIG. 4 sets forth a section view of leash plug 25 taken along section lines 4—4 in FIG. 3. Leash plug 25, as described above, forms a generally cylindrical member having a cylindrical sidewall 61 and parallel planar top and bottom surfaces 64 and 62 respectively. As is also described above, leash plug 25 defines spaced upper apertures 66 and 67, a slot 63 and a connecting U-shaped passage 65 therebetween. In accordance with the present invention, ankle leash 22 is threaded through aperture 66 and returns upwardly through aperture 67 to form a loop which is captivated within U-shaped passage 65. Thus, ankle leash 22 may be conveniently secured within and removed from leash plug 25 in accordance with its use as a safety device in the manner described above.

Figure 5:
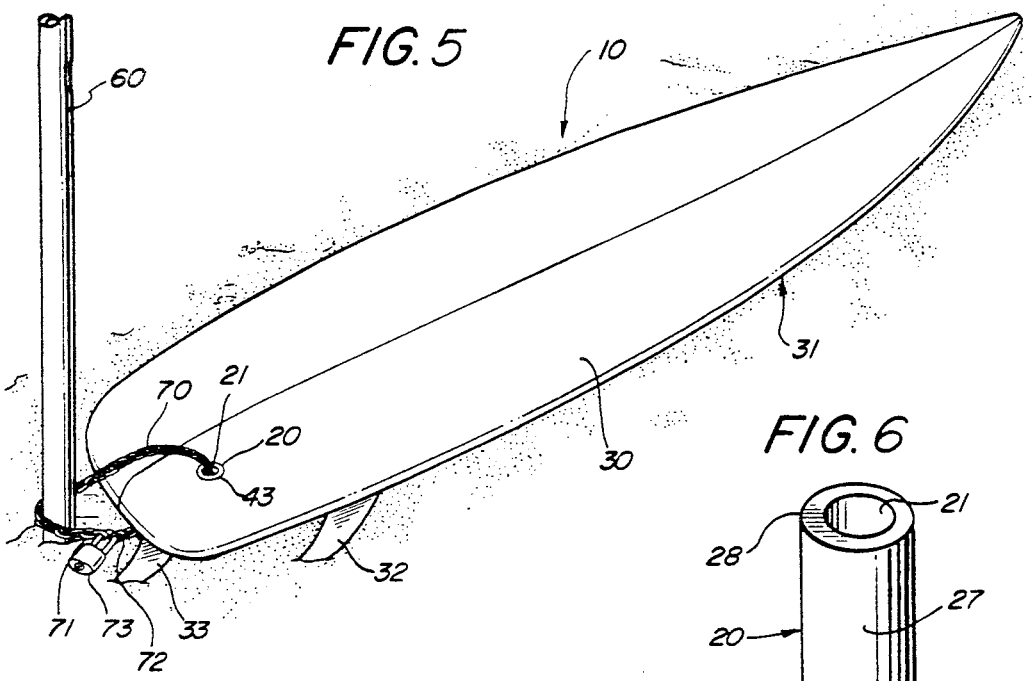
FIG. 5 sets forth a perspective view of the present invention combination leash attachment and lock securing a typical surfboard.

FIG. 5 sets forth an example of the manner in which the present invention leash attachment and lock may be used to secure surfboard 10 and prevent theft thereof. Accordingly and as described above, surfboard 10 includes an undersurface 31 and an upper surface 30 together with a plurality of downwardly extending fins such as fins 32 and 33 supported by undersurface 31. As described above, surfboard 10 further supports a plug receptacle 20 constructed in accordance with the present invention and defining a center passage 21 extending therethrough. As is also described above, plug receptacle 20 defines a top edge 43 preferably flush with upper surface 30 of surfboard 10. In accordance with the attachment of leash plug 25 described above, FIG. 5 depicts the use of the present invention leash attachment and lock having leash plug 25 and ankle leash 22 removed from plug receptacle 20. As is shown above, the removal of plug receptacle 25 and ankle leash 22 leaves center passage 21 of plug receptacle 20 clear and unobstructed from upper surface 30 to undersurface 31. Thus, in accordance with the present invention, a locking device such as a length of chain 70 may be passed through center passage 21 and drawn about a convenient secure attachment member such as post 60 such that ends 71 and 72 of chain 70 may be secured by a conventional lock 73. When so confined, surfboard 10 is securely attached to post 60 and the danger of theft of surfboard 10 is greatly reduced. It will be apparent to those skilled in the art that virtually any kind of locking apparatus may be used in combination with plug receptacle 20 to secure surfboard 10. For example, chain 70 may be replaced by a cable or other locking device having sufficient strength to thwart attempts to steal surfboard 10. Similarly, an alternate locking device resembling leash plug 25 may be utilized in which a securing element such as security cable or metal chain has been substituted for ankle leash 22. In such case, the security chain or cable may then be drawn upwardly through center passage 21 of plug receptacle 20 in the manner shown for ankle leash 22 in FIG. 2 and thereafter secured to a convenient attachment by a conventional lock such as lock 73.

Figure 6:
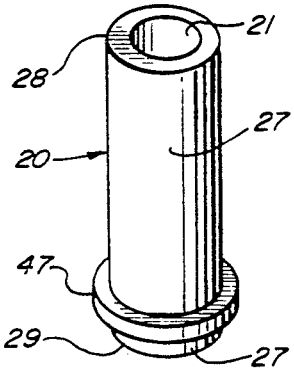
FIG. 6 sets forth a perspective view of a plug receptacle constructed in accordance with the present invention.

FIG. 6 sets forth a perspective view of plug receptacle 20. Receptacle 20 defines a generally cylindrical member having a center passage 21 extending therethrough and defining a generally cylindrical wall 27. Plug receptacle 20 further defines a cylindrical end 28 and a cylindrical end 29 encircling center passage 21. A radially extending lip 47 extends outwardly from cylindrical wall surface 27 and is closer to end 29 than end 28 for reasons set forth below in greater detail.

Figure 7:
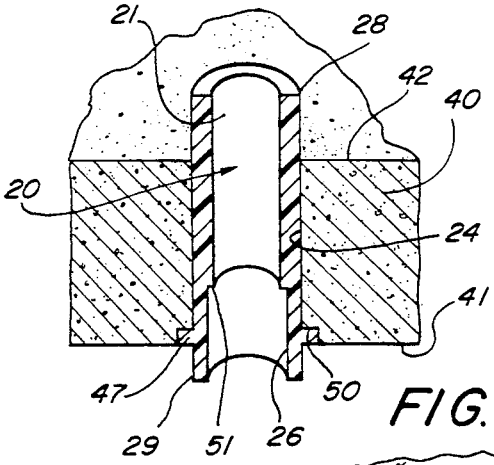
FIGS. 7, 8 and 9 set forth partial section views of the major steps in the installation of the present invention plug receptacle within a typical surfboard.
Figure 8:
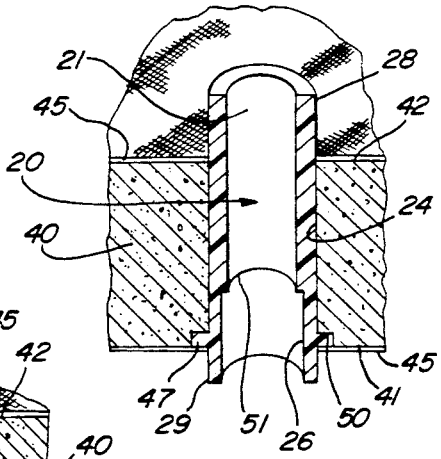
Figure 9:
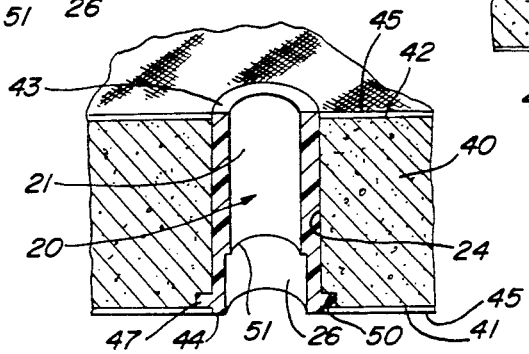

FIGS. 7, 8 and 9 set forth partial section views depicting the sequential assembly of plug receptacle 20 within surfboard 10 in accordance with the present invention.

Specifically, with regard to FIG. 7, foam core 40 defines an upper surface 42 and an undersurface 41 and a buoyant foam core extending therebetween. In accordance with the present invention, a cylindrical aperture 24 has been cut in or drilled through foam core 40. In further accordance with the present invention, an annular recess 50 concentric with cylindrical aperture 24 has been formed in undersurface 41 encircling cylindrical aperture 24. Thereafter, plug receptacle 20, which as described above, defines a generally cylindrical member having a cylindrical outer wall 27 and end portions 28 and 29 together with a radially extending lip 47 is received within cylindrical aperture 24 such that lip 47 is nested within recess 50. It will be apparent to those skilled in the art that aperture 24 and cylindrical wall 27 are sized to provide a precise tight-fit between plug receptacle and aperture 24 of foam core 40. In the position shown in FIG. 7, end 28 extends above upper surface 42 of foam core 40 and end 29 of plug receptacle 20 extends beyond undersurface 41. In addition, in its preferred form, lip 47 is generally flush with undersurface 41. In accordance with the assembly and fabrication process which is described below, plug receptacle 20 is securely maintained within foam core 40 by the cooperation of lip 47, recess 50 and the fiberglass layer applied to undersurface 41. However, an adhesive layer may be applied to cylindrical aperture 24 and cylindrical wall 27 to further secure plug receptacle 20 within foam core 40.

FIG. 8 sets forth the next major step in the fabrication process of the present invention leash attachment and lock mechanism in which foam core 40 is covered by fiberglass skin 45. It should be noted that fiberglass skin 45 is formed on both surfaces of foam core 40 so as to abut and form a sealing attachment within cylindrical wall 27. In addition, it should be noted that in accordance with an important aspect of the present invention, the portion of fiberglass skin 45 which extends along undersurface 41 of foam core 40 also overlies and captivates lip 47 of plug receptacle 20 within recess 50. Thus, in accordance with an important aspect of the present invention, plug receptacle 20 is securely anchored within foam core 40 once fiberglass 45 is installed. It should also be noted that at this point in the fabrication of the present invention combination leash attachment and surfboard lock, end portions 28 and 29 of plug receptacle 20 extend a significant distance beyond fiberglass skin 45.

FIG. 9 sets forth the final major step in the assembly and fabrication process in which end portions 28 and 29 of plug receptacle 20 have been sanded or otherwise reduced until top edge 43 and bottom edge 44 of plug receptacle 20 have been formed in a flush alignment with fiberglass skin 45. Thus, in the completed fabrication shown in FIG. 9, plug receptacle 20 is securely assembled within foam core 40 and, in accordance with the present invention, securely attached and maintained therein by fiberglass skin 45. Thus, in the completed assembly shown in FIG. 9, leash plug 25 and ankle leash 22 may be received within plug recess 26 in the attachment shown above for surfboard utilization or, alternatively, leash plug 25 may be removed and a suitable locking device used to secure surfboard 10 in the manner described above. In addition, it will be apparent to those skilled in the art that in the event surfboard 10 is to be used without an ankle leash, a suitable fabricated plug may be inserted into center passage 21 of plug receptacle 20 to cover center passage 21 and permit normal surfboard operation.

What has been shown in a convenient, reliable and easy to use combination leash attachment and lock for a surfboard. The invention shown provides a secure assembly of a plug receptacle within a surfboard foam core such that a locking device or an ankle leash may be conveniently attached to the surfboard.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in a surfboard having a body portion, top and bottom surfaces, a cylindrical aperture therebetween having a recess proximate said bottom surface, a combination leash attachment and lock means comprising:

a plug receptacle having a generally cylindrical body and an extending lip portion received within said recess, a passage therethrough and upper and lower edge portions;

means supporting said plug receptacle within the surfboard such that said upper and lower edge portions thereof are generally flush with the top and bottom surfaces of the surfboard; and a leash plug, defining a body and upper and lower surfaces and having leash attachment means for securing an ankle leash including a U-shaped passage forming an elongated slot at said lower surface and a pair of spaced apart apertures at said upper surface, configured for removable assembly to said plug receptacle.

2. A combination leash attachment and lock means as set forth in claim 1 wherein the recess defined in the bottom surface of the surfboard is annular and wherein said extending portion of said plug receptacle defines an annular lip.

3. A combination leash attachment and lock means as set forth in claim 2 wherein said plug receptacle defines a plug recess proximate said lower edge portion having a greater diameter than said passage.

4. A combination leash attachment and lock means as set forth in claim 3 wherein said passage and said plug recess of said plug receptacle are generally cylindrical.

5. A combination leash attachment and lock means as set forth in claim 4 wherein said leash plug defines a generally cylindrical member having a diameter less than that of said plug recess and greater than that of said passage.

6. A method for fabricating a combination leash plug and lock for a surfboard having a foam core and outer skin, said method comprising the steps of:

forming a foam core having a top and bottom surface;

forming a first passage through the foam core;

forming a recess in the bottom surface of the foam core adjacent the first passage;

inserting a plug receptacle, having top and bottom ends, a second passage therethrough, an outer surface conformed generally to the first passage and an extending lip, into the first passage such that the top end extends beyond the top surface of the foam core and the bottom end extends beyond the bottom surface of the foam core and the lip is received within the recess in the foam core;

covering the foam core with a skin such that the skin abuts the outer surface of the plug receptacle and overlies the lip portion thereof; and removing the extending portions of the top and bottom ends of the plug receptacle to form top and bottom end surfaces generally flush with the skin.

7. The method of claim 6 wherein said step of covering the foam core includes:

applying one or more layers of fiberglass laminations.

8. The method of claim 7 wherein said inserting step includes:

applying an adhesive to the outer surface of the plug receptacle before insertion.

9. The method of claim 7 wherein said step of forming a first passage includes:

cutting a generally cylindrical hole in the foam core.

10. The method of claim 9 wherein said step of forming a recess includes:

cutting a generally cylindrical annular recess generally concentric with the cylindrical hole in the foam core.

11. The method of claim 10 wherein said removing step includes sanding the top and bottom ends of the plug receptacle.

* * * * *